US005139318A

United States Patent [19]

Broxup

[11] Patent Number: 5,139,318

[45] Date of Patent: Aug. 18, 1992

[54] TRANSFER ARRANGEMENT FOR SEALABLE ENCLOSURE

[75] Inventor: Kenneth H. Broxup, Bristol, England

[73] Assignee: The Secretary of State for Defence in Her Britannic Majesty's Government of the United Kingdom of Great Britain and Northern Ireland, London, England

[21] Appl. No.: 671,819

[22] PCT Filed: Jul. 31, 1989

[86] PCT No.: PCT/GB89/00868

§ 371 Date: Apr. 1, 1991

§ 102(e) Date: Apr. 1, 1991

[87] PCT Pub. No.: WO90/01773

PCT Pub. Date: Feb. 22, 1990

[30] Foreign Application Priority Data

Aug. 1, 1988 [GB] United Kingdom ..... 8818268.8

[51] Int. Cl.[5] ..... A47B 44/02

[52] U.S. Cl. ..... 312/1

[58] Field of Search ..... 312/1, 3, 296, 329

[56] References Cited

U.S. PATENT DOCUMENTS 4,915,272 4/1990 Vlock ..... 312/1

FOREIGN PATENT DOCUMENTS 0187558 4/1986 European Pat. Off. .
1539845 9/1968 France .
2040616 1/1971 France .
2441244 6/1980 France .

*Primary Examiner*—Joseph Falk
*Attorney, Agent, or Firm*—Nixon & Vanderhye

[57] ABSTRACT

An arrangement for transferring items to or from e.g. a glovebox, in a closed moveable container, the glovebox port has a door having a non-rotatable outer portion (12) and a rotatable inner portion (13). The container (2) has a lid having a non-rotatable outer portion (3) and a rotatable inner portion (4), the outer portion (3) having a thin lip (10). The port has a thin lip (19) which can be aligned with the lip (10) of the lid. The outer portion (12) of the door retains a peripheral sealing ring (17) and the rim of the container retains a similar ring (8) which can sandwich and bridge the two lips. The container (2) is attached to the port by a rotatable locking ring (27). Via an externally rotatable and slidable shaft (35), linked at its inner end to the inner portion (13) of the door, the latter is rotatable to disengage the door from the port, couple this inner portion (13) to that of the lid (4), disengage the lid from the container (2), and move the coupled door and lid back and laterally away from the port, and vice versa.

5 Claims, 7 Drawing Sheets

59
39
58
71
36
37
39
42
35
63
70
1
55
48
51
69
47
48
49
53
54
57
52
48
57
26
25

62
61
2
65
65
11
66
9
8
6
7
7
60
10
101
3
67
67
29
4
29
27
64
30
28
64
31
31
24
20
68
16
16
15
17
18
111
12
13
22
22
23

TRANSFER ARRANGEMENT FOR SEALABLE ENCLOSURE

BACKGROUND OF THE INVENTION

1. Field of the Invention

This invention relates to transfer arrangements for transferring items to and from a sealable enclosure, by means of a sealable, moveable container, with minimum exposure of their interiors, or escape of gas therefrom, to the environment. It has one application in transferring samples of radioactive material from eg a glovebox to eg an enclosed electron microscope, for examination and vice versa.

2. Discussion of Prior Art

In some known arrangements for this purpose, the enclosure and the container have respectively a port sealed by a door and an opening sealed by a lid. In operation, the container is first sealed to the enclosure, and the door and lid, locked together, are opened inwards of the enclosure to allow the transfer of items between the two. In these arrangements the door and lid are hinged to swing inwards of the enclosure, but this is only possible where the enclosure allows sufficient space, as is not always the case. Also in these arrangements the door is only openable from inside the enclosure by a gloved hand.

SUMMARY OF THE INVENTION

In French Patent No. 1,539,845 an arrangement is described whereby operation of a single knob effects simultaneous engagement of door and lid, disengagement of door from enclosure and disengagement of lid from container. The door and lid can then be retracted into the enclosure, but there is no explanation as to how they are supported therein. Operation of the knob is described as being effected from within the enclosure, either manually or by means of a manipulator, although there is no description of any manipulator.

It is one object of the present invention to provide an arrangement which does not involve an inward swinging door, and another to provide one in which the door is openable from outside the enclosure. Other advantages will become apparent in the course of the description of an embodiment of the invention.

According to the present invention a transfer arrangement for transferring items from a sealable enclosure by means of a sealable container removably attachable to the enclosure comprises:

an enclosure having a port including an inwardly extending first thin lip;

a door for said port comprising a non-rotatable outer portion and a rotatable inner portion sealed to the outer portion, said outer portion having a sealing member located at its rim;

a container having an opening with a sealing member located at its rim, said port having means for engaging said container;

a lid for said container comprising a non-rotatable outer portion and a rotatable inner portion sealed to the outer portion, said outer portion having an outwardly extending second thin lip, said second thin lip being of slightly smaller external diameter than the internal diameter of said first thin lip and so arranged that, when the two lips are aligned edge-to-edge, the two aforesaid sealing members can sandwich and bridge the two lips;

the inner portion of said door having attached thereto a member extending beyond its outer portion for engaging, upon rotation, the periphery of the port within the enclosure and also having attached thereto means for engaging, upon rotation, the outer portion of said lid;

the inner portion of said lid having attached thereto means for engaging, upon rotation, the rim of said container;

axially separable means for coupling the inner portions of door and lid to cause their common rotation when coupled;

and is characterised in having means operable from outside the enclosure for rotating the inner portion of said door to simultaneously engage or disengage the door from the port. and the lid from the container and disengage or engage the door and the lid, and for moving the locked-together door and lid back and laterally away from the port within the enclosure.

Said operating means may comprise:

a shaft extending into and sealed to said enclosure adjacent said port, said shaft having secured to its inner end a linkage to the inner portion of said door for rotating said inner portion by rotating the shaft;

said shaft being axially slidable inward of the enclosure and said linkage being arranged thereupon to withdraw the door and lid when locked together, back into the enclosure;

said shaft, when slid inwards, being rotatable to move the coupled-together door and lid laterally away from the port.

Said means for engaging said container to said port may comprise a locking ring rotatably secured to, and rotatable about, said port to engage the rim of said container. When said locking ring is rotated to engage said rim, it may be arranged to free a member which thereby permits rotation of said shaft and which, upon said shaft rotation, prevents further rotation of said locking ring.

The rim of the container may comprise parts which, when the closed container is pushed against the closed port, contact spring members attached to and surrounding the port whose consequent deflection releases the locking ring for rotation.

Said means for engaging upon rotation may comprise lugs in one engageable member locatable in alignment with slots in a lip or rim of the other engagable member and rotatable relative thereto to engage said lip or rim.

BRIEF DESCRIPTION OF THE DRAWINGS

An embodiment of the invention will now be described, by way of example, with reference to the accompanying drawings, wherein.

DETAILED DISCUSSION OF PREFERRED EMBODIMENTS

In these drawings the front panel of an enclosure is shown at 1, the rear panel at 25 and its four sides at 26. This small enclosure simulates that of a particular proprietory electron microscope; the glovebox with which the present embodiment is used is higher, wider and deeper than this enclosure. A removable cylindrical container 2 for the transfer of items to and from the enclosure is shown attached to a port in panel 1.

Figure 5:
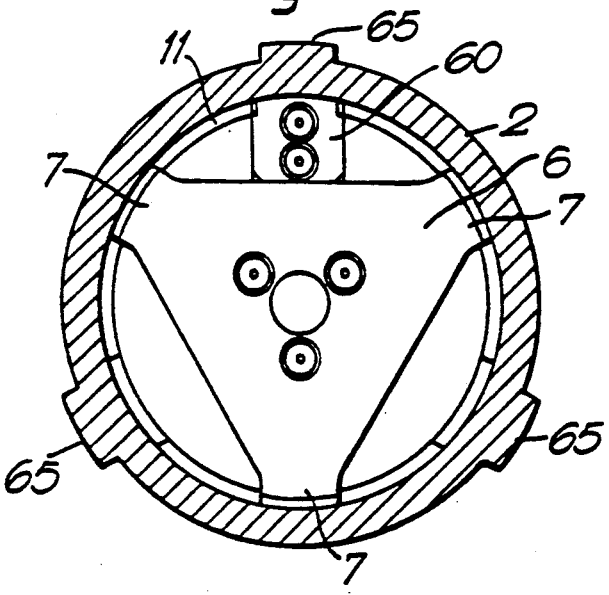
FIG. 5 is a part-section on the line V—V in FIG. 3.

Container 2 is closed by a lid which comprises a non-rotatable annular portion 3 and a central portion 4 which is rotatable within portion 3 but sealed thereto by O-rings 5. Secured to the face of portion 4 which is towards the container is a plate 6 having three peripheral lugs 7 (FIG. 5). A flat rubber sealing ring 8 and spacer 9 fitted in a recess in a rim 101 of container 2 makes a seal with a radially inwardly extending thin lip 10 on the edge of portion 3 which extends about halfway across ring 8. The lid portion 3 is held tight against the rim of the container 2 by the lugs 7 when rotation of the latter causes them to engage a step 11 on the inside of the container. The rim of the container has three 120°-spaced external lugs 65 (FIGS. 5 and 10), and three 120°-spaced internal slots 66 (FIG. 10) for entry of the lugs 7.

Figure 4:
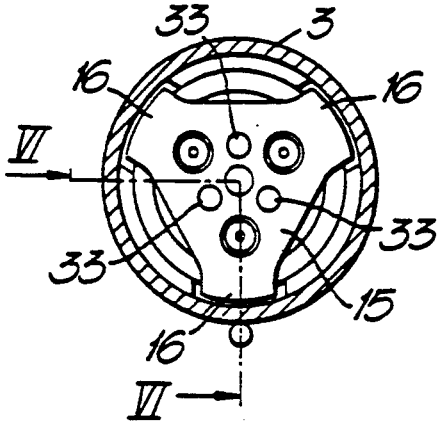
FIG. 4 is a part-section on the line IV—IV in FIG. 3.

The enclosure 1 is closed by a door which comprises a non-rotatable annular portion 12 and a central portion 13 which is rotatable within portion 12 but sealed thereto by O-rings 14. Secured to the face of portion 13 which is towards portion 4 is a plate 15 having three peripheral lugs 16 (FIG. 4) which can engage a recess in a rim of portion 3 having three 120°-spaced slots 67 (FIG. 10) for entry of the lugs 16.

A flat rubber sealing ring 17 and spacer 18 fitted in a recess 110 in a rim 111 of portion 12 make a seal with a radially outwardly extending thin lip 19 on the inner face of a ring 20 sealed to the front of the enclosure by an O-ring 21. The thin lip 19 is aligned with lip 10 and likewise extends almost halfway across the ring 17, leaving only a narrow gap between the edges of the two lips. The door portion 12 is held tight against the ring 20 by the three lugs 22 on a rotatable dished portion 23 secured to the face of portion 13 which is towards the interior of the enclosure; rotation of the lugs 22 causes them to engage an inward extending lip 24 on the inner end of ring 20 having three 120°-spaced slots 68 (FIG. 10) for entry of the lugs 22.

Figure 6:
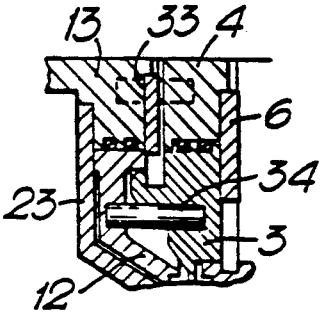
FIG. 6 is a part-section on the line VI—VI in FIG. 4.

Three dowel pins 33 are secured in rotatable portion 13 and extend through plate 15 into rotatable portion 4, being a sliding fit in the two latter so as to be axially withdrawable. A single dowel pin 34 (FIG. 6) is secured in non-rotatable portion 3 and extends into non-rotatable portion 12, being a sliding fit in the latter.

Figure 1:
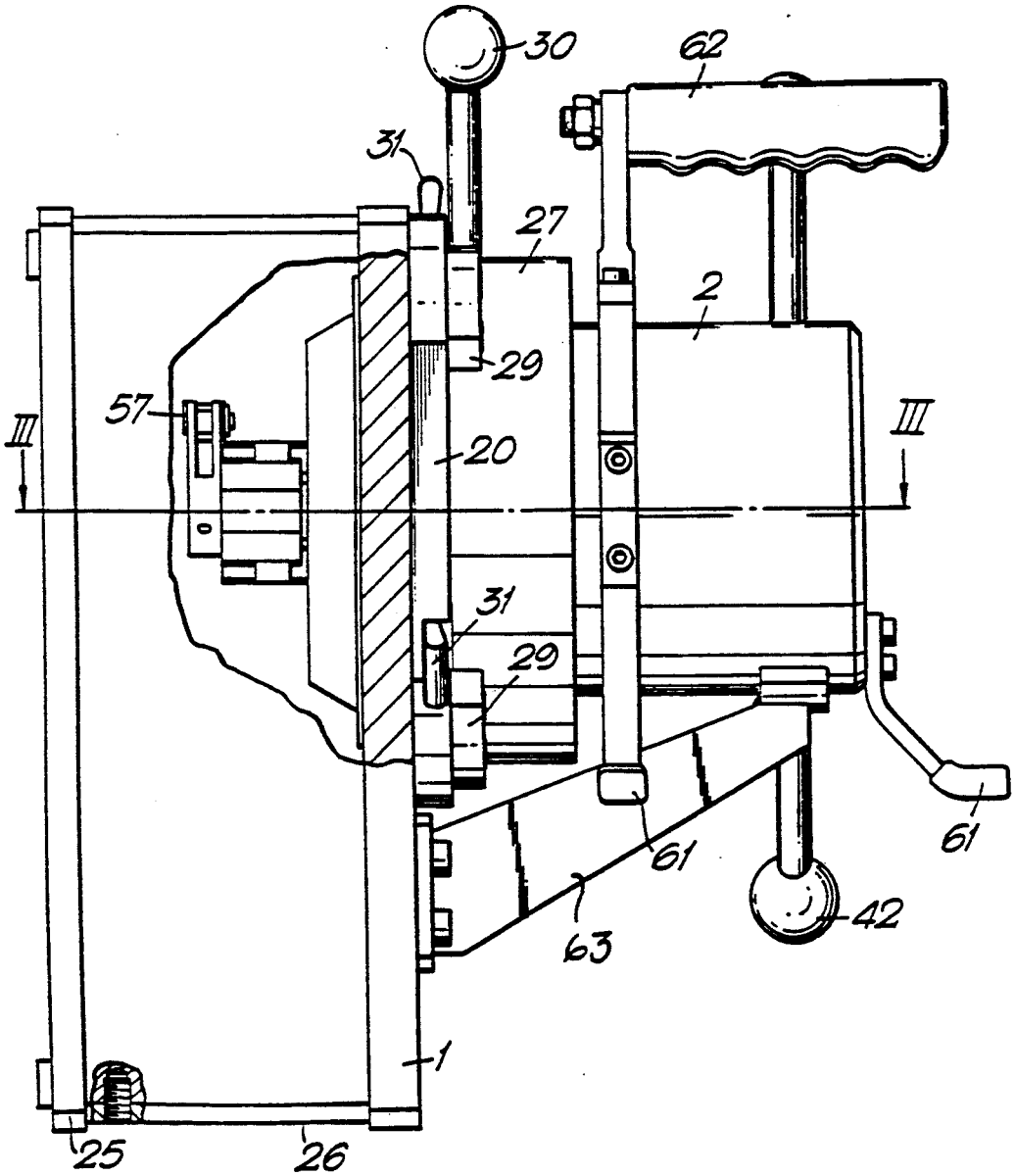
FIG. 1 is a side elevation of an embodiment of the invention, partially cut away.
Figure 2:
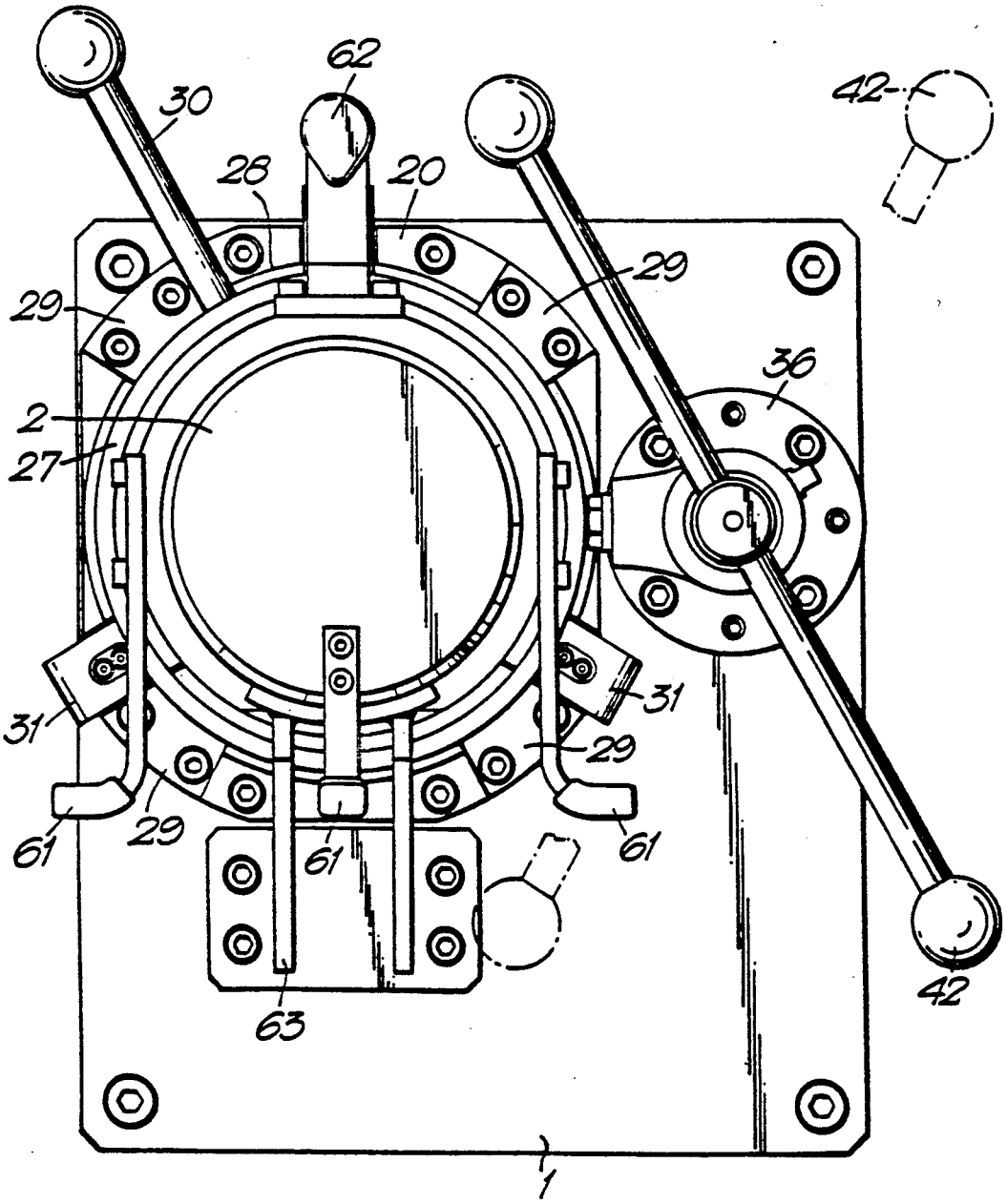
FIG. 2 is a front view of the embodiment of FIG. 1.
Figure 3:
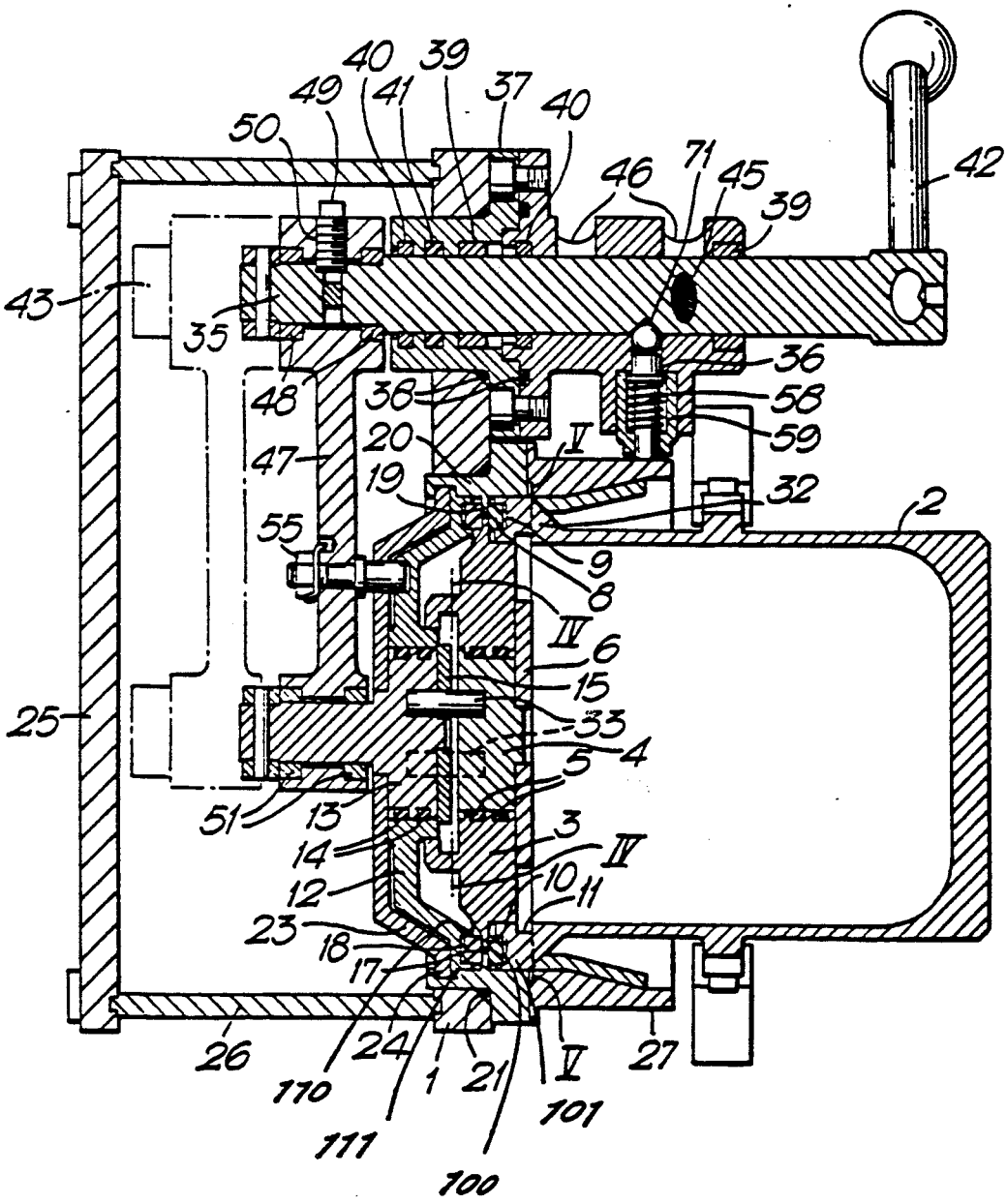
FIG. 3 is a cross-section on the line III—III of FIG. 1.
Figure 10:
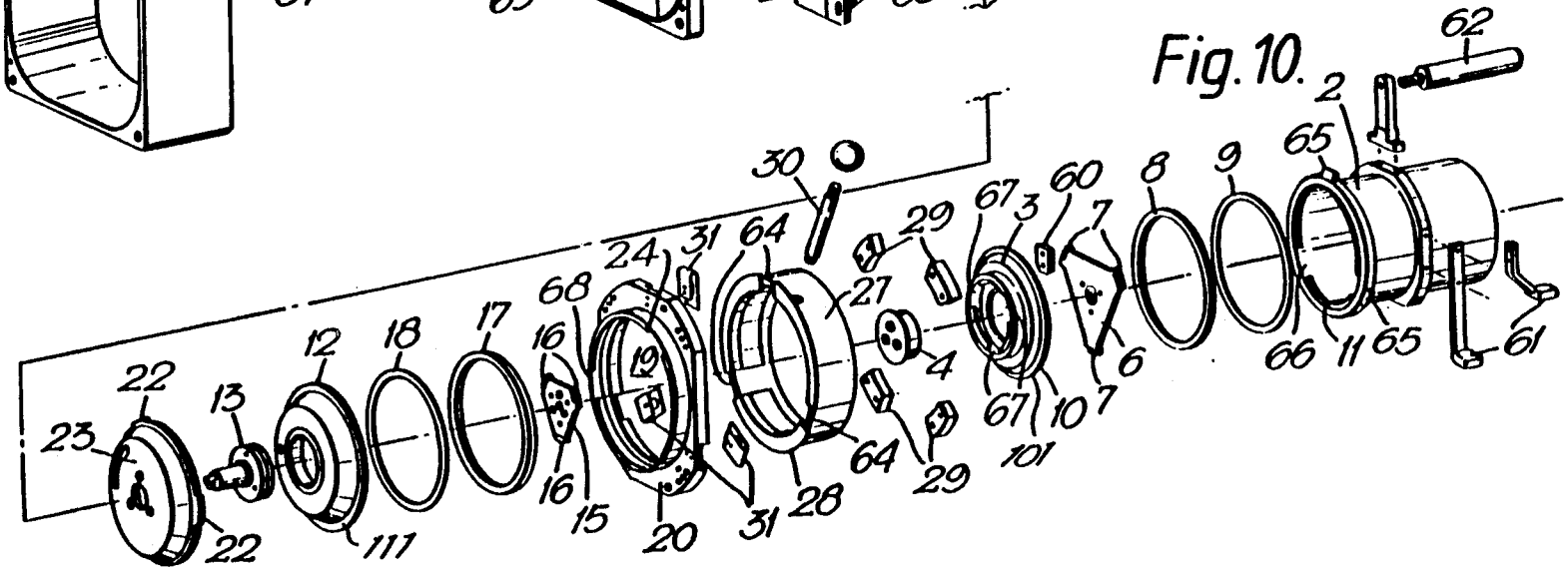
FIG. 10 is an exploded view of certain other parts of the embodiment of FIG. 1.

A rotatable locking ring 27 has an outward extending lip 28 which is located in a recess in ring 20 and retained therein by four plates 29 secured to ring 20 and overlapping lip 28. Ring 27 is rotatable through 60° by a lever 30 attached thereto, between limits defined by the contact of lever 30 with the sides of the two upper plates 29 (FIG. 2). Also secured to recesses in ring 20 are three leaf springs 31. The locking ring 27 bears on three lugs 65 on the rim of container 2 to hold it against ring 20. In the lip 28 are three 120°-spaced slots 64 (FIG. 10).

A shaft 35 extends through an outer housing 36 secured to the panel 1, and through an inner housing 37 secured to outer housing 36, into the enclosure. These two housings are sealed by O-rings 38 to each other and to the panel 1. The two housings contain bushes 39, shaft wipers 40 and a shaft seal 41. Shaft 35 is rotatable by a lever 42 and can be moved axially between its position shown hatched and that indicated at 43. This movement is limited by a pin 44 (FIG. 8) screwed into shaft 35 at 45, which runs in a U-shaped slot 46, in housing 36. The inner end of shaft 35 passes through one end of a support arm 47 containing bushes 48. A pin 49 screwed into shaft 35 runs in a 60° circumferential slot 50 in this end of arm 47. The other end of arm 47 contains bushes 51 and engages a rearward extension of rotatable portion 13. To the end of shaft 35 and the rearward extension of portion 13 are keyed crank arms 52 and 53 respectively (FIG. 7), whose outer ends are interconnected by a turnbuckle 54 pivotted at its ends by pins 57. A pin 55 secured to support arm 47 passes through a 60° slot 56 in rotatable portion 23 and is a sliding fit in non-rotatable portion 12.

A pin 58, is spring-loaded towards shaft 35 in housing 36 by a spring 59. The locking ring 27 includes a hole 120 (FIG. 8) for the pin 58 to enter when ring 27 is rotated to its locking position, as will be described. This allows shaft 35 to rotate by forcing a ball 71 at the end of pin 58 out of a detent (not shown) in shaft 35, compressing spring 59, and also locks the ring 27 in position.

The container 2 is fitted with three legs 61 and a carrying handle 62, and a cradle 63 is mounted on the panel 1 to support the container 2 in alignment with the ring 20 etc.

FIGS. 1–8 are to scale, and the external diameter of container 2 is 106 mm.

The operation of the arrangement is as follows. Assume that the container 2 is separated from the enclosure with the container lid and the enclosure door closed, and with an item in the container which is to be transferred to the enclosure. Both are at a pressure of, say, −5 mbar relative to the ambient pressure in the surrounding environment.

Figure 8:
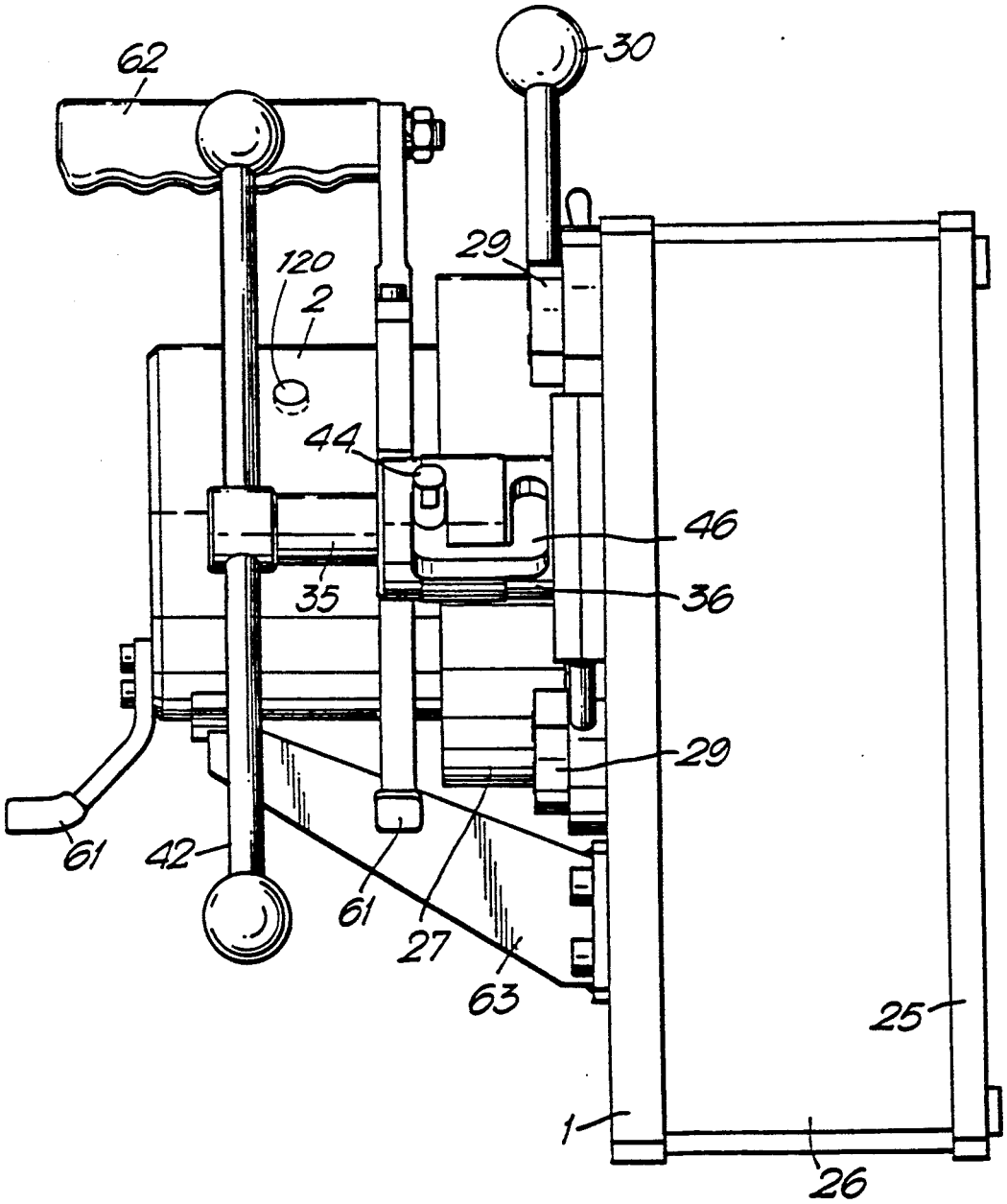
FIG. 8 is an elevation of the opposite side of the embodiment of FIG. 1.
Figure 9:
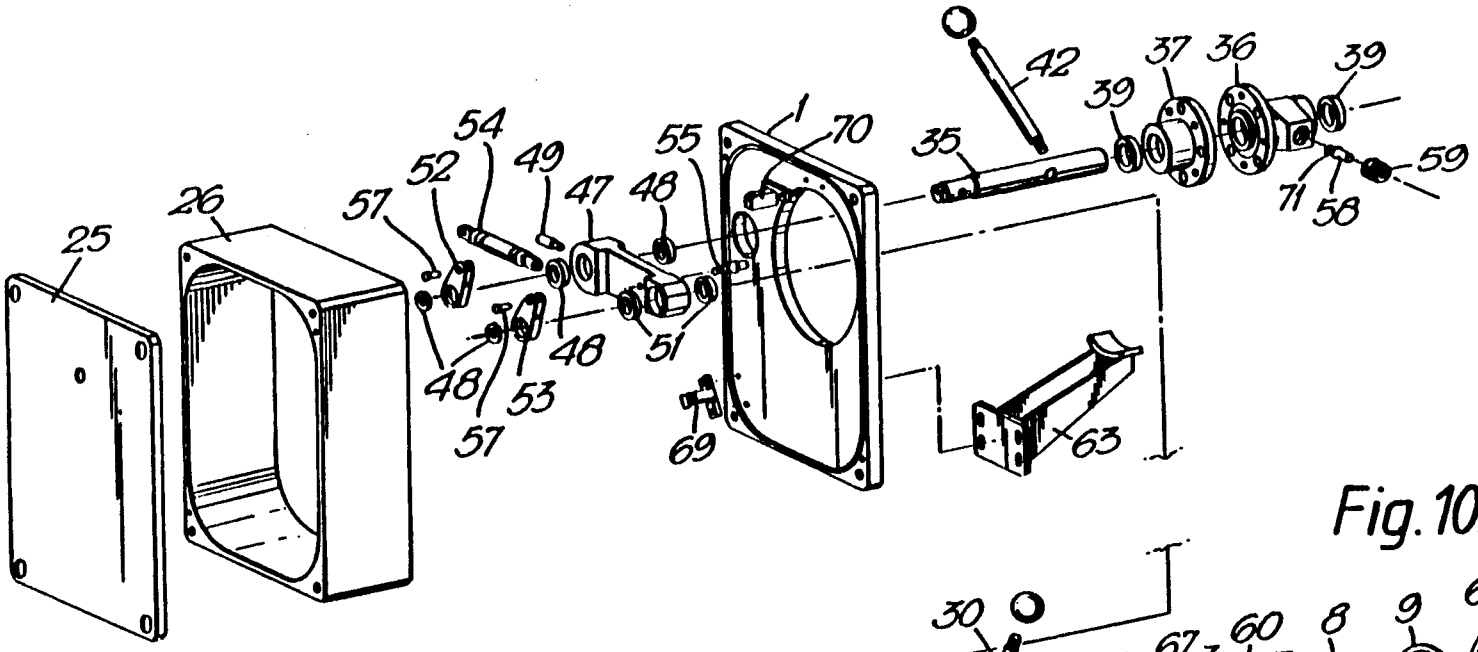
FIG. 9 is an exploded view of the embodiment of FIG. 1 showing certain parts only.

The lever 30 is in the position shown in FIG. 2 so that the slots 64 are located as in FIG. 10. The container 2 is aligned on the cradle 63 as shown in FIG. 8, with the lugs in register with the slots 64. The container is pushed forward so that the lugs 65 pass through the slots 64 and depress the springs 31 which until then had engaged the slots 64 and prevented the locking ring 27 from turning. The lever 30 is turned 60° clockwise to rotate the locking ring 27, which thereby engages the lugs 65 and locks the container 2 onto the ring 20. Engagement of locating pin 34 (FIG. 6) ensures the correct circumferential alignment between the non-rotatable portion 3 of the lid and the non-rotatable portion 12 of the door.

Rotation of the ring 27 through 60° allows the pin 58 to enter the aforesaid hole 120 in ring 27 when shaft 35 is rotated, which locks the ring to housing 36. Shaft 35 is in the hatched position in FIG. 3 with the lever 42 in the position shown in FIG. 2. The lever 42 is turned 60° clockwise (its travel controlled by the length of one arm of U-slot 46) which activates the following via crank arm 47 and turnbuckle 54:

(a) The lugs 7 rotate to the position of slots 66, thereby releasing lid portion 3 from container 2.

(b) The lugs 16 rotate away from the position of slots 67 to engage the rim of lid portion 3.

(c) The lugs 22 rotate to the position of slots 68, thereby releasing dished portion 23 from ring 20.

These simultaneous actions lock the door and lid together and move pin 49 to the other end of the slot 50 in arm 47. By pushing shaft 35 forward 30 mm (its travel controlled by the axial length of U-slot 46), the door/lid assembly is moved clear of the enclosure port into the enclosure and is left hanging on the pin 49.

Figure 7:
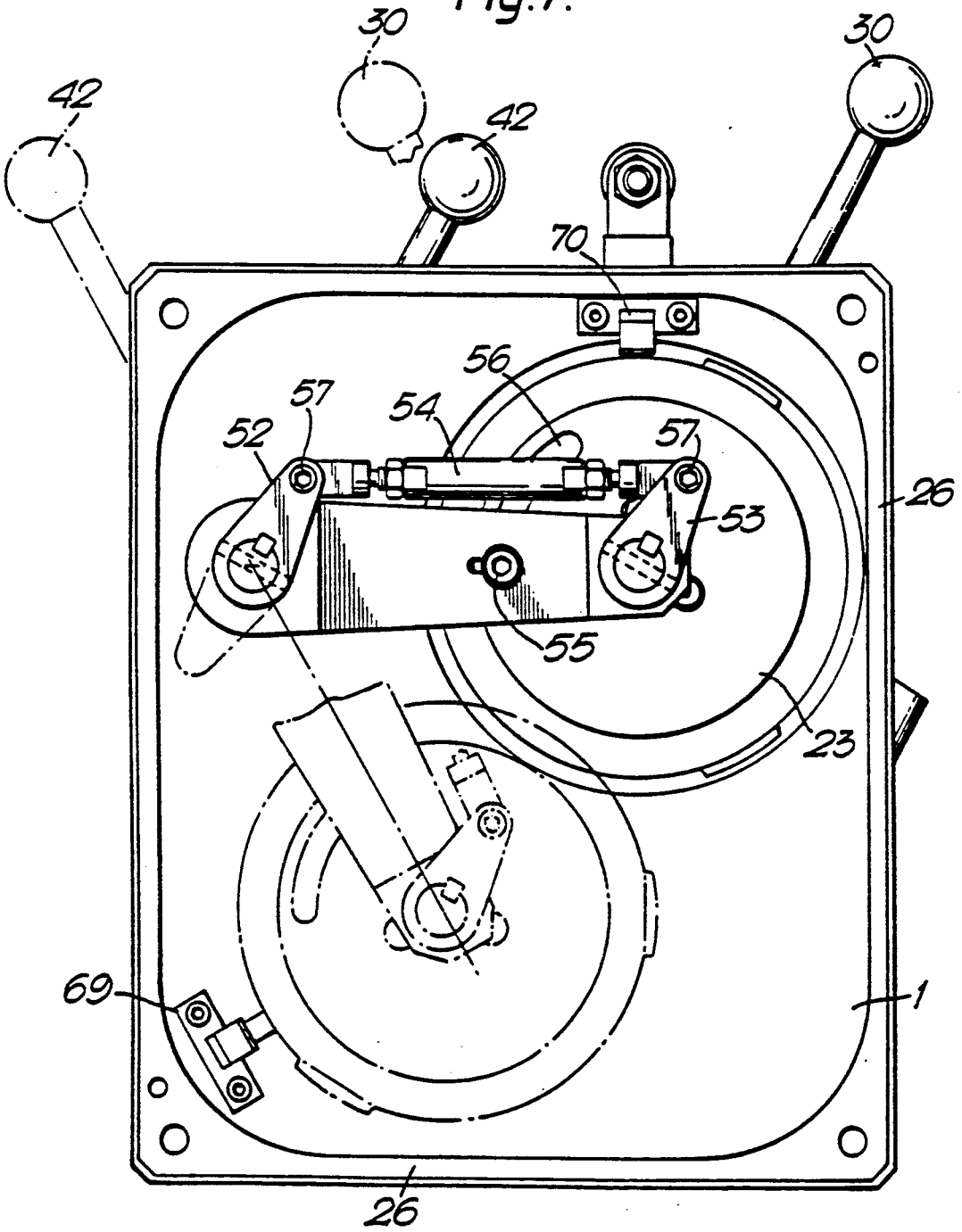
FIG. 7 is a rear view of the embodiment of FIG. 1 with the rear panel removed.

The shaft 35 is then turned 60° anti-clockwise (its travel controlled by the length of the other arm of U-slot 46) to move the assembly laterally away from the port and drop it onto a travel stop 69 fixed to the panel 1 (FIG. 7). Transfer of the item from the container into the enclosure can now be effected either by remote-control equipment or manually using glove-box gauntlets (neither shown), in a conventional manner.

All the lugs are tapered circumferentially for ease of engagement and subsequent compression of the seals, when rotated.

To remove the container from the enclosure, the above sequence is reversed, beginning by turning shaft 35 clockwise until the door/lid assembly abuts a travel stop 70 fixed to panel 1 (FIG. 7). Correct alignment of this assembly with the ring 20 is ensured by the engagement of the locating pin 55 fixed to arm 47 with non-rotatable door portion 12. A key 60 (FIG. 5) enters the uppermost slot 66 in the rim of container 2 to maintain correct circumferential alignment between the non-rotable lid portion 3 and the container rim when lugs 7 pass through these slots and are rotated to lock the lid on.

The spread of contamination is substantially prevented and the vacuum sealing is maintained by the described seals and wipers associated with shaft 35. The main sealing of the container lid and the enclosure door is effected by the flat sealing rings 8 and 17 respectively, which sandwich and bridge the two lips 10 and 19, and depends on selection of their correct thickness and flexibility; these characteristics also determine the forces necessary to operate the arrangement.

It will be seen that the only areas which are exposed to the interior of the container/enclosure when the door and lid are released and moved laterally (FIG. 7), and subsequently exposed to the environment, e.g. the air in a laboratory, when the container is removed, are the thin (1.5 mm) edges of lips 19 and 20 and the narrow (1 mm) central portion of the faces of seals 8 and 17 extending between these edges. Also, only the very small volume of container/enclosure gas in the annulus bounded by these edges and faces can escape into the environment. Hence the possibility of spreading contamination is minimised. It will also be seen that with the container 2 removed, it is impossible to remove the enclosure door because locking ring 27 cannot be rotated until the springs 31 are depressed to free them from the slots 64 in the ring.

I claim:

1. A transfer arrangement for transferring items from a sealable enclosure by means of a sealable container removably attached to the enclosure comprising:

an enclosure having a port including a radially inwardly extending first thin lip;

a door for said port comprising a non-rotatable outer portion and a rotatable inner portion sealed to the outer portion, said outer portion having a rim and a sealing member located at said rim;

a container having a rim and an opening with a sealing member located at said container rim, said port having means for engaging said container to said port;

a lid for said container comprising a non-rotatable outer portion and a rotatable inner portion sealed to the outer portion, said outer portion having a radially outwardly extending second thin lip, said second thin lip being of slightly smaller external diameter than the internal diameter of said first thin lip and so arranged that, when the two lips are aligned edge-to-edge, each of said door sealing member and said container sealing member comprise a means for bridging the two lips;

the inner portion of said door having attached thereto a member extending beyond its outer portion for engaging, upon rotation, the periphery of the port within the enclosure and also having attached thereto means for engaging, upon rotation, the outer portion of said lid;

the inner portion of said lid having attached thereto means for engaging, upon rotation, the rim of said container;

axially separable means for coupling the inner portions of door and lid to cause their common rotation when coupled;

and operating means for rotating the inner portion of said door thereby simultaneously engaging or disengaging the door from the port, the lid from the container and for disengaging or engaging the door and the lid, and for moving the locked-together door and lid back and laterally away from the port within the enclosure.

2. An arrangement as claimed in claim 1 characterised in that said operating means comprises:

a shaft (35) extending into and sealed to said enclosure (1, 25,26) adjacent said port, said shaft (35) having secured to its inner end;

a linkage (47) to the inner portion (13) of said door (12,13) for rotating said inner portion (13) by rotating the shaft (35); said shaft (35) being axially slidable inward of the enclosure (1,25, 26) and said linkage (47) being arranged thereupon to withdraw the door (12, 13) and lid (3, 4) when locked together, back into the enclosure;

said shaft (35) when slid inwards, being rotatable to move the coupled-together door (12, 13) and lid (3, 4) laterally away from the port.

3. An arrangement as claimed in claim 1 or characterised in that said means for engaging said container to said port comprises a locking ring (27) rotatably secured to, and rotatable about, said port to engage the rim of said container (2).

4. An arrangement as claimed in claim 3 wherein, when said locking ring is rotated to engage said rim, said ring frees a spring loaded pin by allowing said pin to enter an aperture in said ring which thereby permits rotation of said shaft and which, upon said shaft rotation, prevents further rotation of said locking ring.

5. An arrangement as claimed in claim 1 characterised in that the rim of the container comprises parts (65) which, when the closed container (2) is pushed against the closed port, contact spring members (31) attached to and surrounding the port whose consequent deflection releases the locking ring (27) for rotation.

* * * * *